US012791257B2

(12) United States Patent
Denoual

(10) Patent No.: US 12,791,257 B2
(45) Date of Patent: Nov. 10, 2026

(54) HEAT EXCHANGER

(71) Applicant: VALEO SYSTEMES THERMIQUES, La Verriere (FR)

(72) Inventor: Christophe Denoual, La Verriere (FR)

(73) Assignee: Valeo Systemes Thermiques, La Verriere (FR)

( * ) Notice: Subject to any disclaimer, the term of this patent is extended or adjusted under 35 U.S.C. 154(b) by 584 days.

(21) Appl. No.: 18/001,829

(22) PCT Filed: Jun. 17, 2021

(86) PCT No.: PCT/EP2021/066454
§ 371 (c)(1),
(2) Date: Dec. 14, 2022

(87) PCT Pub. No.: WO2021/259762
PCT Pub. Date: Dec. 30, 2021

(65) Prior Publication Data

US 2023/0228497 A1 Jul. 20, 2023

(30) Foreign Application Priority Data

Jun. 24, 2020 (FR) ..... 2006593

(51) Int. Cl.
*F28D 9/00* (2006.01)
*F28F 9/02* (2006.01)
*F28D 21/00* (2006.01)

(52) U.S. Cl.
CPC ..... *F28D 9/005* (2013.01); *F28F 9/0253* (2013.01); *F28D 2021/008* (2013.01);
(Continued)

(58) Field of Classification Search
CPC ..... F28D 9/005; F28D 9/0253; F28D 2021/0008; F28F 2275/04; F28F 2280/06; F28F 9/0256; F28F 9/0251; F28F 9/00248
See application file for complete search history.

(56) References Cited

U.S. PATENT DOCUMENTS 8,186,719 B2 * 5/2012 Kume ..... F28F 9/0246 165/176
2010/0243200 A1 * 9/2010 Baker, Jr. ..... F28D 9/005 165/41
2022/0011061 A1 1/2022 Azzouz et al.

FOREIGN PATENT DOCUMENTS

CN 102466420 A 5/2012
CN 105473976 A 4/2016
(Continued)

OTHER PUBLICATIONS

European Patent Office, International Search Report (with English translation) and Written Opinion of corresponding International Application No. PCT/EP2021/066454, dated Sep. 14, 2021.
(Continued)

*Primary Examiner* — Joel M Attey
(74) *Attorney, Agent, or Firm* — Osha Bergman Watanabe & Burton LLP

(57) ABSTRACT

The present invention relates to a heat exchanger for a motor vehicle, having a heat exchange bundle, at least one fluid connection block for entry or exit of at least one fluid in the heat exchange bundle and an end plate configured to interact with the at least one fluid connection block by means of an opening. At least one part of the fluid connection block is laterally offset with respect to a circulation wall of the end plate.

8 Claims, 7 Drawing Sheets

(52) U.S. Cl.
CPC ..... *F28F 9/0251* (2013.01); *F28F 9/0256* (2013.01); *F28F 2275/04* (2013.01); *F28F 2280/06* (2013.01)

(56) References Cited

FOREIGN PATENT DOCUMENTS

| | | | |
|---|---|---|---|
| CN | 105659050 | A | 6/2016 |
| CN | 109154474 | A | 1/2019 |
| CN | 110100142 | A | 8/2019 |
| EP | 2551626 | A1 | 1/2013 |
| FR | 2916514 | A1 | 11/2008 |
| FR | 3086381 | A1 | 3/2020 |
| JP | H11118368 | A | 4/1999 |
| WO | 2017201252 | A1 | 11/2017 |
| WO | 2018046451 | A1 | 3/2018 |

OTHER PUBLICATIONS

Office Action issued in corresponding China Application No. 202180045033.6, dated Jun. 19, 2026. (6 pages).

* cited by examiner

HEAT EXCHANGER

TECHNICAL FIELD

The present invention relates to the field of heat exchangers, in particular those intended to equip air-conditioning systems and/or cooling systems of motor vehicles.

BACKGROUND OF THE INVENTION

In the automotive sector, it is common to have to modify a temperature of a component such as an electric motor, a battery, a device for storing heat and/or cold energy, or the like. To this end, the motor vehicle is equipped with a heat exchanger which comprises a heat exchange bundle within which a coolant and a heat transfer fluid circulate. More specifically, the heat exchange bundle comprises a plurality of plates stacked on one another. The plurality of plates thus helps delimit a plurality of channels in which the heat transfer fluid and the coolant circulate such that they are capable of exchanging heat with each other within the heat exchange bundle. In order to convey the heat transfer fluid and the coolant into the heat exchange bundle, at least one connection block is secured to the heat exchange bundle, such that it is in fluidic communication with the plurality of channels of the heat exchange bundle.

SUMMARY OF THE INVENTION

It will be understood from the foregoing that the connection between the connection block and the heat exchange bundle needs to be sealed so that the supply to the channels of the heat exchange bundle is optimal. To this end, at least one filler material is added between the connection block and the heat exchange bundle so that it fuses during a brazing operation in order to create adhesion between the two parts and so that it thus ensures sealing between the connection block and the bundle. During the manufacture of this type of heat exchanger, particular care must be taken with the addition of the filler material, because it is understood on the one hand that if no filler material is added, for example if the operator forgets, this prevents the parts from being secured during brazing, and on the other hand that if the filler material is not added correctly this may lead to poor adhesion of the parts to one another during brazing. In each case, heat exchanger sealing problems may result.

The aim of the present invention is therefore to overcome the problems mentioned above by making it possible, by a simple means, to verify sealing between the connection block and the heat exchange bundle. In this way, the reliability of the heat exchanger and its service life within a motor vehicle are optimized.

The invention therefore relates to a heat exchanger for a motor vehicle comprising a heat exchange bundle and at least one fluidic connection block allowing at least one fluid to enter and/or leave the heat exchange bundle, the heat exchange bundle comprising a plurality of plates stacked on one another such that they delimit between them a plurality of circulation channels for the at least one fluid, each plate comprising a circulation wall surrounded by a downward peripheral edge which extends the circulation wall in the direction away from the fluidic connection block, an end plate arranged at the top of the stack being configured to interact with the at least one fluidic connection block, the end plate comprising at least one opening for fluidic communication between the heat exchange bundle and the fluidic connection block arranged covering the at least one opening, said at least one opening being delimited by a neck which protrudes from the end plate in the direction away from the heat exchange bundle, the fluidic connection block comprising a groove intended to receive the neck of the end plate, characterized in that the at least one opening delimited by a neck is formed in a corner of the end plate such that a part of the fluidic connection block, comprising at least a first angular part of the groove, is offset laterally with respect to the circulation wall of the end plate.

The heat exchanger may be a heat exchanger configured to cool at least one component of a motor vehicle, such as an electrical storage device, and may also equip an air-conditioning system of said motor vehicle.

The plurality of channels formed by the stack of plates of the heat exchange bundle ensures the circulation of a heat transfer fluid and a coolant within said heat exchange bundle. More specifically, the channels are made in the heat exchange bundle such that they allow alternate circulation of the heat transfer fluid and of the coolant, in order to allow heat exchanges between these two fluids. It is therefore understood that some of the channels are arranged for the circulation of the heat transfer fluid and other channels are arranged for the circulation of the coolant.

The fluidic connection block thus allows the heat transfer fluid or the coolant to enter or leave the heat exchange bundle. To this end, the end plate of the heat exchange bundle comprises the opening delimited by the neck which contributes to a sealed connection and optimum positioning of the connection block on the end plate during the manufacture of the heat exchanger. More specifically, the opening surrounded by the neck is made in one of the corners of the end plate such that the part of the connection block is offset laterally with respect to the circulation wall of the end plate. In other words, the groove formed in the fluidic connection block is not completely covered by the circulation wall of the end plate and said groove is partially open to the outside of the heat exchange bundle, in its first angular part.

The advantage of such a configuration of the opening and of the connection block is in particular that verification of sealing between said connection block on the one hand and the opening and the associated neck on the other hand is facilitated, in the first angular part of the groove which is in communication with the external environment of the heat exchanger.

According to one example of the invention, the at least one part of the connection block faces a portion of the downward peripheral edge of the end plate. The part of the fluidic connection block which is not covered by the circulation wall of the end plate is however arranged such that it does not extend laterally beyond the overall envelope defined by the heat exchanger.

According to one example of the invention, the at least one part of the connection block and a portion of the downward peripheral edge of the end plate are arranged relative to one another such that their respective projections on a main plane of extension of the circulation wall of the end plate are substantially coincident.

According to one example of the invention, the connection block comprises at least one channel which allows the fluid to pass through the connection block from or toward the heat exchange bundle, the groove in the connection block being formed concentrically around said channel.

It will be understood that the channel in the connection block allows the heat transfer fluid or the coolant to pass through the connection block to supply fluid to the channels of the heat exchange bundle.

According to one example of the invention, the groove in the connection block is delimited laterally by an inner peripheral wall and an outer peripheral wall having a gap therebetween of a value greater than the value of the thickness of the neck of the opening.

It will be understood from this structural feature that the neck is not forcibly inserted into the groove in the connection block during the manufacture of the heat exchanger. This makes it possible in particular to ensure that the neck is pushed sufficiently far into the groove so that the connection can be sealed.

The neck is in contact at least with the inner peripheral wall of the groove of the connection block, at least in the first angular part of the groove. This allows the first angular part of the groove to be in communication with the external environment of the heat exchanger.

According to one example of the invention, the inner peripheral wall of the connection block helps to laterally delimit the groove and the channel in said connection block.

According to one example of the invention, the inner peripheral wall of the groove is at least partially in contact with the neck of the opening and the outer peripheral wall of the groove is at a non-zero radial distance from the neck of the opening.

According to one example of the invention, the inner peripheral wall of the groove is entirely in contact with the neck of the opening and the outer peripheral wall of the groove comprises a first angular portion in contact with the circulation wall of the end plate and a second angular portion forming the part of the fluidic connection block offset laterally with respect to the circulation wall of the end plate, an end face of which facing the heat exchange bundle is free from any contact. It will thus be understood that an inner diameter of the neck and an outer diameter of the inner peripheral wall are substantially identical, such that the entire neck is in contact with the inner peripheral wall of the groove.

It should be noted that the second angular portion of the outer peripheral wall corresponds to the first angular part of the groove which is in communication with the outside of the heat exchanger.

According to one example of the invention, the inner peripheral wall of the groove and the outer peripheral wall of the groove define between them a space in communication with the external environment of the heat exchanger.

It will thus be understood that the space of the groove, in the first angular part of this groove and therefore in communication with the external environment of the heat exchanger, facilitates verification, on the one hand, of the presence of a filler material in the groove in the connection block and, on the other hand, of sealing of the connection between the connection block and the opening in the end plate following brazing of the filler material housed in the groove in the connection block.

According to one example of the invention, at least one filler material is arranged in the groove in the connection block.

The filler material has the function of contributing to sealing between the connection block and the opening in the end plate, by deformation by fusion and adhesion during brazing of the heat exchanger.

According to one example of the invention, the groove comprises a bottom wall connecting the inner peripheral wall and the outer peripheral wall, the at least one filler material being arranged near the bottom wall.

According to one example of the invention, the filler material is in contact with the neck. In this way, optimum sealing is ensured between the connection block and the opening in the end plate of the heat exchange bundle following brazing of the heat exchanger. The filler material may in particular be interposed between the neck and the bottom wall.

According to one example of the invention, the at least one fluidic connection block is configured to cover two openings formed in the end plate each in a corner of the end plate of the heat exchange bundle, this connection block comprising two different channels with a groove formed concentrically around each of the channels and able to interact with a neck arranged around one of the openings.

It will be understood in this case that the end plate comprises at least a first opening and a second opening, each made in a corner of the end plate. More specifically, the first opening and the second opening are both delimited by a neck and are each made in a corner of the end plate such that a first part and a second part of the fluidic connection block, each comprising a first angular part respectively of a first groove and of a second groove, are offset laterally with respect to the circulation wall of said end plate.

According to one example of the invention, four fluidic connection blocks allowing the fluid to enter and/or leave the heat exchange bundle are arranged in each of the corners of the end plate of said heat exchange bundle, each of the connection blocks covering at least one opening delimited by a neck of the end plate and each of the connection blocks comprising a part offset laterally with respect to the circulation wall of the end plate.

According to one example of the invention, the part of each of the connection blocks that is offset laterally with respect to the circulation wall of the end plate of the heat exchange bundle faces the downward peripheral edge of said end plate.

The invention also relates to a method for manufacturing a heat exchanger according to any one of the preceding features, comprising at least a preliminary assembly step during which the connection block is secured to the end plate of the heat exchange bundle such that at least a part of the connection block is offset laterally with respect to the circulation wall of the end plate, a brazing step during which brazing of the heat exchange bundle and of each connection block is carried out, and a subsequent sealing inspection step during which the first angular part of the groove offset laterally from the circulation wall of the end plate is used in order to stress at least one filler material provided between the connection block and the end plate.

It will be understood that the subsequent step of inspecting sealing is implemented by virtue of the particular structure of the heat exchanger described above, and in particular the part of the connection block, comprising the first angular part of the groove, which is offset laterally and therefore accessible from outside the heat exchanger.

According to one example of the method, during the assembly step, a crimping operation is carried out to fix the position of each connection block covering the at least one opening formed in the end plate.

According to one example of the method, a brazing ring is arranged in the groove in the connection block before the neck of the end plate is mounted in this groove during the preliminary assembly step.

According to an alternative of the method, a liquid filler material is distributed, for example by injection, in the groove in the connection block after the neck of the end plate has been mounted in this groove during the preliminary assembly step.

According to one example of the method, between the preliminary assembly step and the brazing step, the plates intended to form the heat exchange bundle are stacked on one another, the end plate being arranged at the top of the stack of plates.

According to one example of the method, the subsequent step of inspecting sealing consists of a first sub-step of injecting a flow, for example of compressed air or helium, via the first angular part of the laterally offset groove so as to stress the area in which the filler material was initially present before the brazing operation.

It will be understood from this first sub-step that the use of the flow of compressed air makes it possible to stress the area in which the filler material should be fused, in order to test the reliability of the seal. In other words, the flow of compressed air is sent to the area in which the filler material, brazing ring or injected liquid filler material, was present before the brazing operation, in order to ensure that this material has indeed fused with the neck of the opening in the end plate and at least the inner peripheral wall of the groove and optionally with the bottom wall of said groove. In this first sub-step, it is thus ensured in particular that the filler material has indeed been fused and that it is not simply bonded to the connection block and to the neck, which would offer unreliable attachment over time and run the risk of loss of sealing in the medium term.

According to one example of the method, the subsequent sealing inspection step comprises a second sub-step carried out following the first sub-step and during which a fluid is circulated through the fluidic connection block and the heat exchange bundle.

In this way, it is ensured that sealing between the connection block and the opening in the end plate, implemented by the brazed filler material, has been correctly achieved during the manufacture of the heat exchanger. In other words, it is verified that the fluid does not escape from the heat exchanger at the groove in the connection block, by means of the part of the connection block which comprises the first angular part of the groove which is accessible from the external environment of said heat exchanger.

The invention also relates to a thermal system of a motor vehicle comprising at least one heat exchanger according to any one of the preceding features.

BRIEF DESCRIPTION OF DRAWINGS

Further features and advantages of the invention will also emerge, on the one hand, from the following description and, on the other hand, from several example embodiments provided by way of non-limiting indication with reference to the appended schematic drawings in which.

DETAILED DESCRIPTION OF THE INVENTION

It should first of all be noted that, although the figures set out the invention in detail for its implementation, they may of course be used to better define the invention if necessary. It should also be noted that, in all of the figures, elements that are similar and/or perform the same function are indicated using the same numbering.

In the description below, a direction of a longitudinal axis L, a direction of a transverse axis T, and a direction of a vertical axis V are represented by a trihedron (L, V, T) in the figures. A horizontal plane is defined as being a plane perpendicular to the vertical axis, a longitudinal plane is defined as being a plane perpendicular to the transverse axis, and a transverse plane is defined as being a plane perpendicular to the longitudinal axis.

Figure 1:
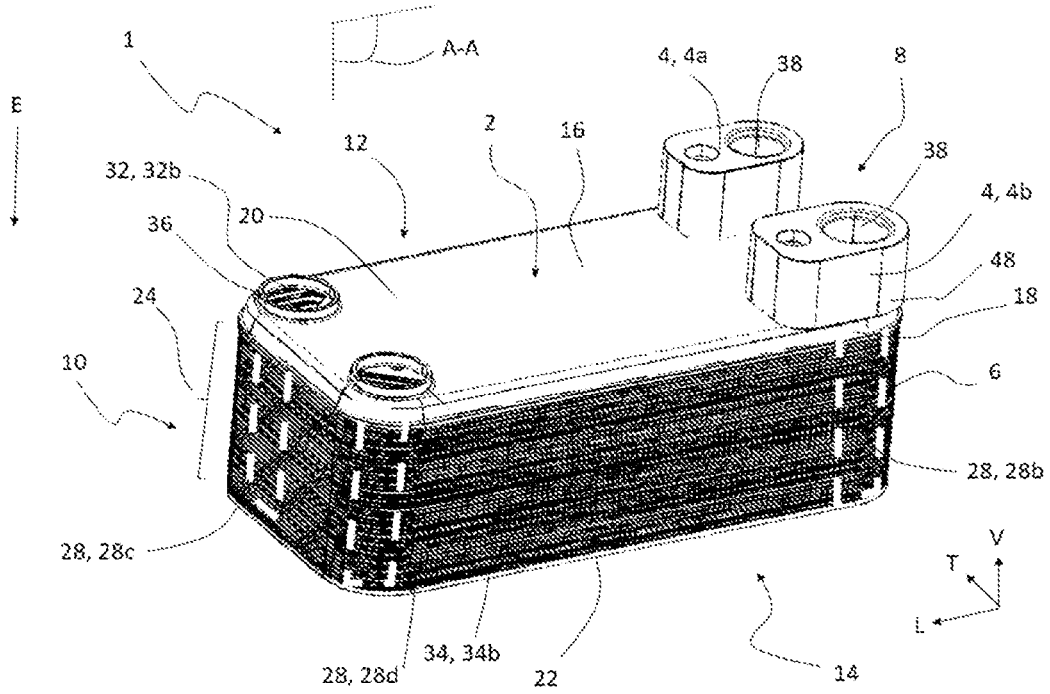
FIG. 1 is a schematic perspective view of a heat exchanger according to the invention.

FIG. 1 shows in perspective a heat exchanger 1 according to the invention which is configured to implement an exchange of heat energy between a heat transfer fluid and a coolant. More particularly, the heat exchanger consists of a plate exchanger comprising a stack of plates one on top of the other, between which the heat transfer fluid and the coolant alternately circulate. The heat transfer fluid may in particular consist of glycol water. The coolant is for example carbon dioxide or a refrigerant known by the acronym R134A or 1234YF.

Such a heat exchanger 1 is arranged at the intersection of two fluid circulation loops, at least one of which is also intended for the thermal regulation of a passenger compartment of the vehicle, or for the thermal regulation of a component of the vehicle, whether this is, for example and without this being limiting, an electrical or electronic component, or an element for motorization of the vehicle.

With reference to FIG. 1, the heat exchanger 1 comprises a heat exchange bundle 2 and at least one fluidic connection block 4, said heat exchange bundle being intended to be connected, where appropriate by this connection block, to fluid intake and outlet ducts, not shown here.

The heat exchange bundle 2 is formed by a stack of plates 6, stacked on one another in a stacking direction E, parallel to the vertical axis V. The heat exchanger 1, and therefore the bundle 2, comprises a first longitudinal end 8 and a second longitudinal end 10 opposite the first longitudinal end 8 along the longitudinal axis L. The heat exchanger 1, and therefore the bundle 2, comprises a first transverse end 12 and a second transverse end 14 opposite the first transverse end 12 along the transverse axis T.

The bundle 2 comprises a first end plate 20 and a second end plate 22 which are distinguished from the other plates of the stack of plates 6 in that they delimit this stack, and therefore the bundle 2, in the stacking direction E. The first end plate 20 is defined as the plate comprising intake openings 32 and outlet openings 34 for the heat transfer fluid and the coolant, which will be described in more detail below.

All of the plates 6 of the bundle 2 thus stacked in the stacking direction E are brazed to one another in order to ensure sealing of said bundle 2. More specifically, the plates 6 of the bundle 2 are brazed together in order to ensure sealing of the heat transfer fluid path and of the coolant path, both made in the bundle 2 by means of a plurality of channels 26. In the same brazing operation, the at least one connection block 4 is also brazed to the bundle 2, and more specifically to the first end plate 20 comprising the intake openings 32 and the outlet openings 34. More specifically, the at least one connection block 4 is brazed in line with one of the openings 32, 34 in the first end plate 20, using a filler material 64, visible in FIG. 2 in its configuration before brazing, which is intended to be fused between said connection block 4 and said first end plate 20 to secure the parts to one another and in particular to ensure sealing between these parts.

Figure 2:
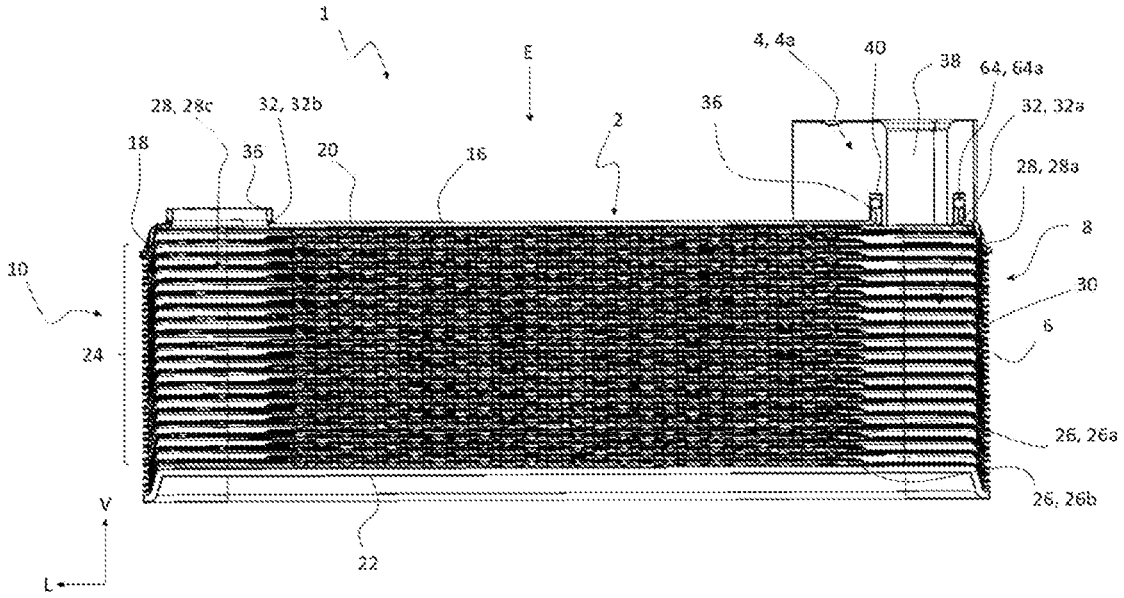
FIG. 2 is a schematic view in section along a vertical and longitudinal plane of the heat exchanger of FIG. 1.

As can be seen in FIGS. 1 and 2, each plate 6 of the heat exchange bundle 2 comprises a substantially flat circulation wall 16, extending in the horizontal plane defined arbitrarily above, surrounded by a downward peripheral edge 18 which extends the circulation wall 16 in the direction away from the first end plate 20 and the at least one fluidic connection block 4 borne by this first end plate.

The plates 6 are arranged between these two end plates 20, 22 forming a bundle body 24 and delimiting the plurality of channels 26. More specifically, the plates 6 of the bundle body 24 delimit at least a plurality of first channels 26*a* and a plurality of second channels 26*b* configured to be traversed respectively by the heat transfer fluid and the coolant.

As can be seen in FIG. 2 showing a sectional view along the longitudinal plane A-A visible in FIG. 1, two immediately adjacent plates 6 define a first channel 26*a*, in which the heat transfer fluid may circulate, or a second channel 26*b*, in which the coolant may circulate.

In the stack, from the first end plate 20 to the second end plate 22, the first channels 26*a*, arranged for the circulation of the heat transfer fluid, alternate with the second channels 26*b* arranged for the circulation of the coolant. Thus, a first plate 6 helps to delimit the circulation of the heat transfer fluid in collaboration with an adjacent second plate 6, and helps delimit the circulation of the coolant in collaboration with an adjacent third plate 6. One and the same plate 6 is thus in contact with the heat transfer fluid on one side and in contact with the coolant on the other. It will thus be understood that such a structure of the first channels 26*a* and of the second channels 26*b* of the heat exchange bundle 2 allows heat exchanges between the heat transfer fluid and the coolant as mentioned previously.

In order to circulate the heat transfer fluid and the coolant respectively in each of the first channels 26*a* and in each of the second channels 26*b*, manifolds 28, shown schematically in FIG. 1 in dotted lines, are made in the volume of the heat exchange bundle 2. More particularly, the manifolds 28 are made in the heat exchange bundle 2 by stacking, in the stacking direction E, openings 30 formed in each of the plates 6 of the bundle body 24 and partially visible in FIG. 2. In the example illustrated, each of the plates 6 of the bundle body 24 comprises four openings 30 each formed in each of the corners of the circulation wall 16 of said plates 6. The alignment of the openings 30 formed in a corresponding corner of each of the plates 6 thus delimits a volume forming a manifold, the main direction of extension of which is parallel to the stacking direction E of the plates 6.

The heat exchange bundle 2 thus comprises two inlet manifolds and two outlet manifolds to allow each of the fluids to pass through the heat exchanger.

In the example illustrated, the heat exchange bundle comprises a first inlet manifold 28*a* and a first outlet manifold 28*b* arranged at the first longitudinal end 8 of the heat exchanger 1. More specifically, the first inlet manifold 28*a* is arranged in the corner corresponding to the intersection between the first longitudinal end 8 and the first transverse end 12 and this first inlet manifold 28*a* allows the heat transfer fluid to enter each of the first channels 26*a* of the heat exchange bundle 2. The first outlet manifold 28*b* is arranged in the corner corresponding to the intersection between the first longitudinal end 8 and the second transverse end 14 of the heat exchanger 1 and this first outlet manifold 28*b* allows the heat transfer fluid to leave each of the first channels 26*a* of the heat exchange bundle 2. It will thus be understood that the heat transfer fluid has a U-shaped circulation in each of the first channels 26*a* in order to connect the first inlet manifold 28*a* and the first outlet manifold 28*b*, i.e. it circulates in a first direction toward the second longitudinal end 10 of the bundle, along the first transverse end 12, then in a second direction returning toward the first longitudinal end 8 and the outlet manifold, this time along the second transverse end 14.

Likewise, the heat exchange bundle 2 comprises a second inlet manifold 28*c* and a second outlet manifold 28*d* arranged at the second longitudinal end 10. More specifically, the second inlet manifold 28*c* is arranged the intersection between the second longitudinal end 10 and the first transverse end 12 and allows the coolant fluid to enter each of the second channels 26*b* of the heat exchange bundle 2. The second outlet manifold 28*d* is arranged at the intersection between the second longitudinal end 10 and the second transverse end 14 and allows the coolant to leave each of the second channels 26*b* of the heat exchange bundle 2. It will thus be understood that, by analogy with what has been described for the circulation of the heat transfer fluid, the coolant has a U-shaped circulation in each of the second channels 26*b* of the heat exchange bundle 2 in order to connect the second inlet manifold 28*c* and the second outlet manifold 28*d*.

As can be seen in particular in FIGS. 1 and 2, the first end plate 20 comprises intake openings 32 and outlet openings 34 for the heat transfer fluid and the coolant. A first intake opening 32*a*, visible in FIG. 2, is made in the circulation wall 16 of the first end plate 20, such that it is in line with the first inlet manifold 28*a* and forms the port for entry of the heat transfer fluid into the first inlet manifold 28*a* and therefore into the first channels 26*a* of the heat exchange bundle 2.

A first outlet opening, not visible, is made in the circulation wall 16 of the first end plate 20, such that it is in line with the first outlet manifold 28*b* and forms the port for the heat transfer fluid to leave the first outlet manifold 28*b* and therefore the first channels 26*a* of the heat exchange bundle.

A second intake opening 32*b*, visible in particular in FIG. 1, is made in the circulation wall 16 of the first end plate 20, such that it is in line with the second inlet manifold 28*c* and forms the port for entry of the coolant into the second inlet manifold 28*c* and therefore into the second channels 26*b* of the heat exchange bundle 2.

A second outlet opening 34*b*, visible in FIG. 1, is made in the circulation wall 16 of the first end plate 20 such that it is in line with the second outlet manifold 28*d* and forms the port for the coolant to leave the second outlet manifold 28*d* and the second channels 26*b* of the heat exchange bundle 2.

According to one example of an embodiment of the invention, at least one of the intake 32 and/or outlet 34 openings is delimited by a neck 36. According to the example embodiment illustrated, all the intake openings 32 and the outlet openings 34 in the first end plate 20 are delimited by a neck 36. More specifically, each of the necks 36 protrudes from the first end plate 20 in the direction away from the heat exchange bundle 2. The neck 36 makes it possible in particular to connect the intake openings 32 and the outlet openings 34 in the first end plate 20 to a fluid intake and outlet duct, not shown here, where appropriate via the at least one fluidic connection block 4.

According to the example of an embodiment of the invention shown in FIG. 1, the heat exchanger 1 comprises a first connection block 4*a* and a second connection block 4*b* arranged covering the first intake opening 32*a* and the first outlet opening, respectively. The first connection block 4*a* and the second connection block 4*b* each comprise a channel 38 which extends in the vertical direction V of the heat exchanger 1 and passes right through the connection blocks 4 in said vertical direction V such that it allows the fluid, in this case the heat transfer fluid, to pass through the connection blocks 4 from or toward the heat exchange bundle 2. The first connection block 4*a* thus has the function of connecting the first channels 26*a* to an intake duct, not visible, ensuring the supply of heat transfer fluid to the first channels 26*a* by means of the channel 38. The second connection block 4*b* for its part has the function of enabling the heat transfer fluid to be discharged out of the heat exchange bundle 2, via an outlet duct that is not visible, once this fluid has circulated through the first channels 26*a*, by means of the channel 38.

It will be understood that, without departing from the context of the invention, the second intake opening 32*b* and the second outlet opening 34*b* may be directly connected to coolant intake and outlet ducts, or may be fluidically connected to connection blocks, not shown, similar to or different from what has just been described for the first connection block 4*a* and the second connection block 4*b*.

The fluidic connection between the first connection block 4*a* and the first intake opening 32*a* will now be described in more detail with reference to FIGS. 3 to 5. The structural and functional features of the first connection block 4*a* and of the first intake opening 32*a* should be considered to also apply to the second connection block 4*b* and to the first outlet opening. To this end, in the rest of the description, the term connection block 4 will be used to designate the first connection block 4*a* and the second connection block 4*b* when the features apply to both of said connection blocks 4. Likewise, the term first opening 32*a* will be used in the rest of the description to designate the first intake opening 32*a* and the first outlet opening when the features apply to both of said first openings 32*a*.

Each connection block 4 has the shape of a parallelepiped, substantially rectangular, in which a first end face 52 and a second end face 54 are defined, opposite one another in the vertical direction V along which the channel 38 formed in the connection block extends. The first end face 52 is thus the face of the connection block 4 facing the heat exchange bundle 2, brought into contact with the first end plate 20, while the second end face 54 is the face facing away from the heat exchange bundle 2. The channel 38 extends over the entire vertical dimension of the connection block, emerging both on the first end face and on the second end face.

According to the invention, the connection block 4 comprises at least one groove 40 intended to receive the neck 36 associated with the first opening 32*a* in the first end plate 20. The groove 40 in the connection block 4 is formed in the volume of said connection block 4 from its first end face 52, that is to say the groove 40 faces the first end plate 20. The groove 40 is delimited laterally by an inner peripheral wall 42 and an outer peripheral wall 44 connected to one another by a bottom wall 46. The groove 40 is arranged concentrically around the channel 38 in the connection block 4, such that the inner peripheral wall 42 helps to laterally delimit both the groove 40 and the channel 38 in said connection block 4.

Figure 4:
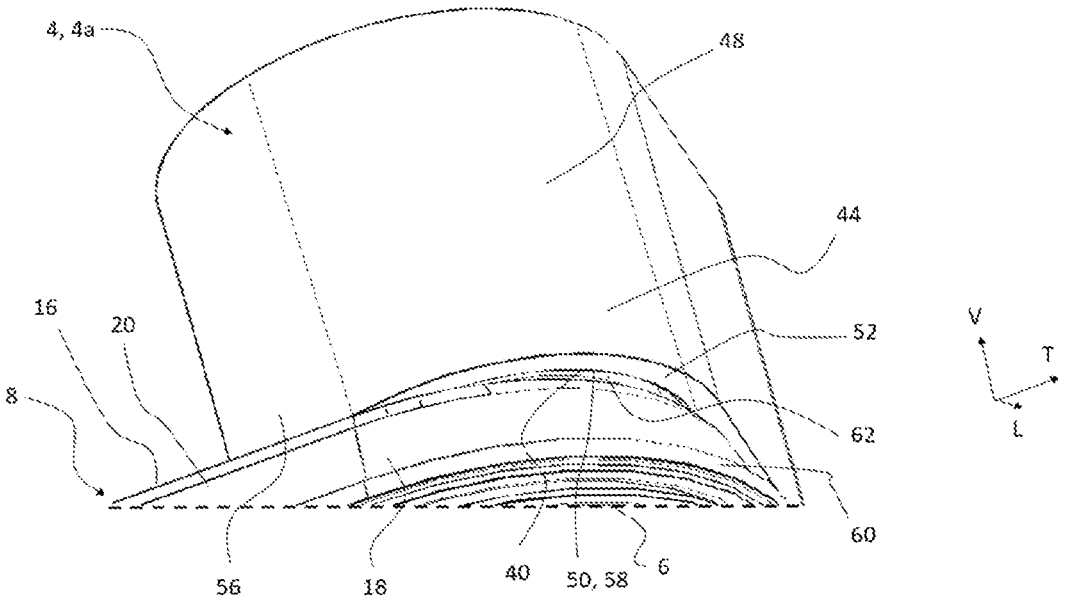
FIG. 4 is a perspective view, from below, of the fluidic connection block of FIG. 3 showing a part of said connection block which is offset laterally with respect to a stack of plates forming the body of the heat exchanger.

According to the invention and as can be seen in particular in FIG. 4, the connection block 4 is arranged covering the first opening 32*a* in the first end plate 20 such that a part 48 of said connection block 4, comprising a first angular part 50 of the groove 40, is offset laterally with respect to the circulation wall 16 of said first end plate 20.

The neck 36 of the first opening 32*a* is arranged in one of the corners of the first end plate 20 sufficiently close to the peripheral edge 18 of said first end plate 20, such that the connection block 4 protrudes partially from the circulation wall 16 and such that the groove 40 in the connection block 4 is partially open, in its first angular portion 50, to an external environment of the heat exchanger 1.

The advantage of such an arrangement is that it makes it possible to facilitate verification by an operator of, on the one hand, the presence in the groove 40 of a filler material 64, before brazing of the heat exchanger 1 and, on the other hand, sealing between the connection block 4 and the first end plate 20 at the end of the brazing step, as will be described in detail below.

Thus, it should be understood that the following structural features of the connection block 4 and of the first opening 32*a* allow the implementation of the invention, that is to say the advantageous positioning of the connection block 4 covering the first opening 32*a* with the first angular part 50 of the groove 40 open to the outside of the heat exchanger, and therefore visible to an operator.

Figure 3:
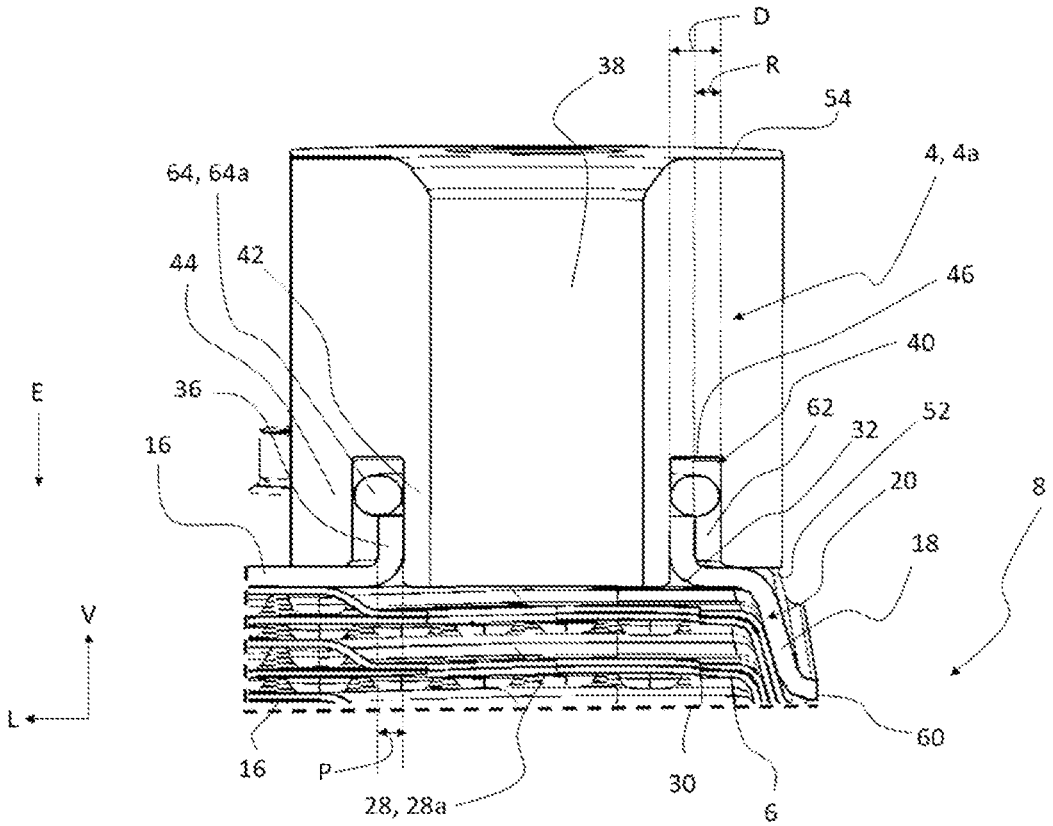
FIG. 3 is a view in section along a vertical and longitudinal plane partially depicting the heat exchanger of FIG. 1, and showing in particular a fluidic connection block and a part of a stack of plates forming the body of the heat exchanger according to a first embodiment of the invention.

As shown in FIG. 3, a gap D formed between the inner peripheral wall 42 and the outer peripheral wall 44 of the groove 40 is defined, the gap D thus having a non-zero value. In other words, this gap D corresponds to the width of the groove measured in the horizontal plane. A thickness P of the neck 36 associated with the first opening is also defined, also measured in a horizontal plane, that is to say along a straight line perpendicular to the stacking direction E of the plates 6 of the heat exchange bundle 2. According to the invention, the value of the gap D is strictly greater than the value of the thickness P of the neck 36.

It will be understood from this feature that, when the heat exchanger is assembled, the neck 36 is received in the groove 40 of the connection block 4 such that it is in contact with the inner peripheral wall 42 at least in the first angular part 50 of the groove 40 which is open to the outside of the heat exchanger.

Thus, and as can be seen in FIG. 3, the inner peripheral wall 42 extending at the first angular portion 50 of the groove 40 is in contact with the neck 36 of the first opening 32*a* while the outer peripheral wall 44 of the groove 40 is at a non-zero radial distance R from the neck 36 of the first opening 32*a*. It will thus be understood that a clearance is provided between the neck 36 and the outer peripheral wall 44 of the groove at least in the first angular part 50 of the groove 40. In this way, the first angular part 50 of the groove 40 is in communication with the external environment of the heat exchanger.

Figure 5:
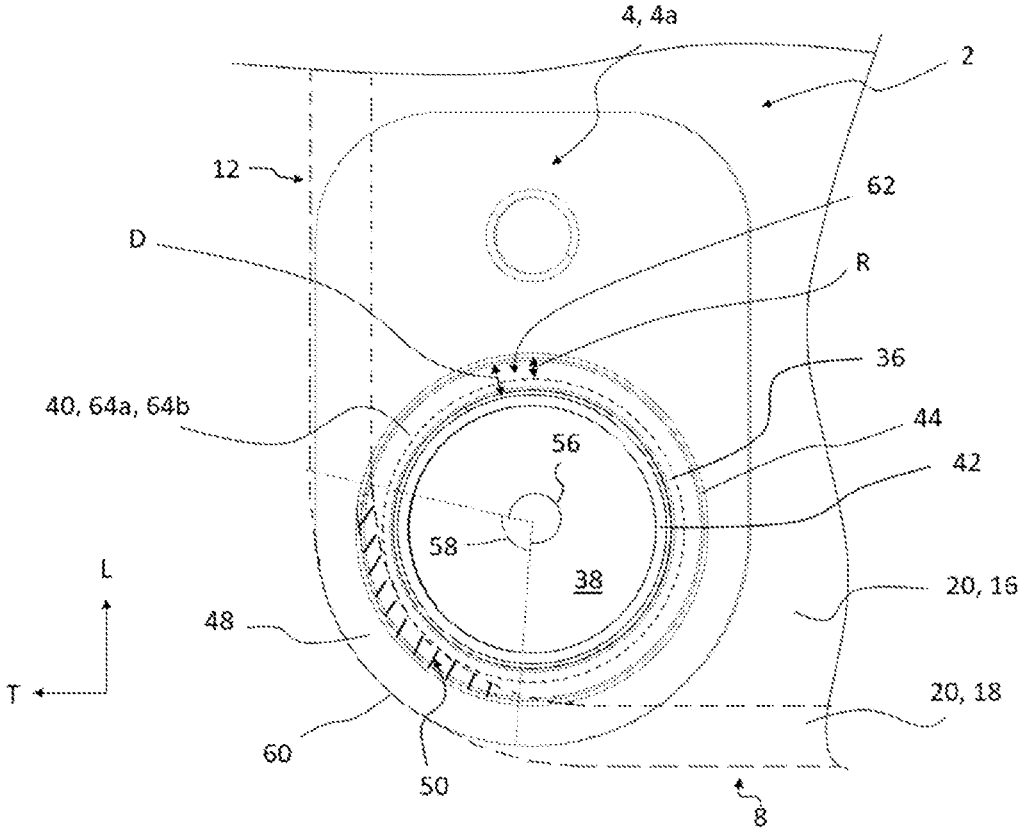
FIG. 5 partially depicts the heat exchanger, seen from below, showing the fluidic connection block arranged covering an opening in an end plate of the heat exchanger, the end plate in this case being transparent and shown in dotted lines.

In the example shown in FIG. 5, an inner diameter of the neck 36 and an outer diameter of the inner peripheral wall 42 of the groove 40 are substantially identical. Thus, the entire neck 36 is in contact with the inner peripheral wall 42 of the groove 40.

A first angular portion 56 of the outer peripheral wall 44 of the groove 40 and a second angular portion 58 of the outer peripheral wall 44 of the groove 40 are distinguished.

The first angular portion 56 of the outer peripheral wall 44 is in contact with the circulation wall 16 of the first end plate 20, and this first angular portion 56 thus corresponds to the part of the connection block 4 of which the first end face 52 is in contact with the circulation wall 16 of the first end plate 20.

The second angular portion 58 of the outer peripheral wall 44 is free from any contact with the circulation wall 16 of the first end plate 20 and therefore corresponds to the part 48 of the connection block 4, comprising the first angular part 50 of the groove 40, which is offset laterally with respect to the circulation wall 16 of the first end plate 20. The first end face 52 of the part 48 of the connection block 4 which is offset laterally with respect to the circulation wall 16 of the first end plate 20 is free from any contact with any element of the heat exchanger 1.

Thus, as can be seen in FIGS. 4 and 5, the part 48 of the connection block 4 comprising the first angular part 50 of the groove 40 is not in contact with the circulation wall 16 but faces a portion of the downward peripheral edge 18 of the first end plate 20. More particularly, the part 48 of the connection block 4 comprising the first angular part 50 of the groove 40 and the downward peripheral edge 18 of the first end plate 20 are arranged relative to one another such that their respective projection on the horizontal plane are substantially coincident.

It will be understood from the foregoing that the part 48 of the connection block 4, in which the first end face 52 is free from any contact with the circulation wall 16 of the first end plate 20, is both laterally free of the circulation wall and is moreover included in a cylindrical envelope of vertical axis delimiting the heat exchanger 1. In other words, this part 48 of the connection block 4 is offset laterally at most as far as in line with a free end 60 of the downward peripheral edge 18 of the first end plate 20.

The advantage of all the preceding features is that a space 62 formed by the gap D between the outer peripheral wall 44 and the inner peripheral wall 42 of the groove 40 is in communication with the external environment of the heat exchanger 1. In this way, access to the area of contact between the neck 36 associated with the first opening 32*a* and the inner peripheral wall 42 of the groove 40 in the connection block 4 is facilitated. Verification of the manufacture of the connection block 4 on the first opening 32*a* in the first end plate 20, and in particular of the quality and sealing of the brazing of the connection block 4 to the first end plate 20, can thus be facilitated by this access to the area of contact via the first part of the groove 50.

The filler material 64 is arranged in the groove 40 in the connection block 4, and in particular in the space 62 in said groove 40. It should be understood, as mentioned above, that the filler material 64 is shown in FIGS. 2 and 3 in an original configuration, in this case in the form of a brazing ring before it is fused to rigidly secure the connection block 4 to the first end plate 20.

The filler material 64 is arranged near the bottom wall 46 of the groove 40, such that it is interposed between the neck 36 of the first opening 32*a* and the bottom wall 46 of the groove 40. The filler material 64 is at least in contact with the neck 36 associated with the first opening 32*a* and with the inner peripheral wall 42 of the groove 40. It is thus possible, during deformation of the filler material 64 during brazing of the heat exchanger 1, to fuse together the connection block 4 and the end plate of the heat exchange bundle via the neck, and to ensure optimum sealing between these two components. In a non-limiting manner, the filler material 64 may be a brazing ring 64*a*, visible in FIGS. 2 and 3, positioned in the groove prior to assembling the connection block 4 on the first end plate 20, or a liquid filler material 64*b*, intended to be injected, via the first part 50 of the groove 40, into this groove 40 once the connection block 4 is in position on the first end plate 20.

It will thus be understood that the space 62 between the inner peripheral wall 42 and the outer peripheral wall 44 of the groove 40 which is in communication with the external environment of the heat exchanger 1 allows an operator to access the filler material 64 at least partially. It is thus possible to verify the presence and/or the correct position of the filler material 64 within the groove 40 of the connection block 4. In other words, a visual inspection of the presence and/or of the correct position of the brazing ring 64*a* or of the liquid filler material 64*b* may be carried out by an operator prior to brazing of the heat exchanger 1.

In a complementary manner, the space 62 between the inner peripheral wall 42 and the outer peripheral wall 44 of the groove makes it possible to verify sealing between the connection block 4 and the first end plate 20, after brazing thereof, in particular by injecting a fluid into the heat exchanger. This ensures that the fluid injected into the heat exchanger does not escape from the bundle 2, by checking more particularly that there is no leak in the first angular part 50 of the groove 40.

Figure 6:
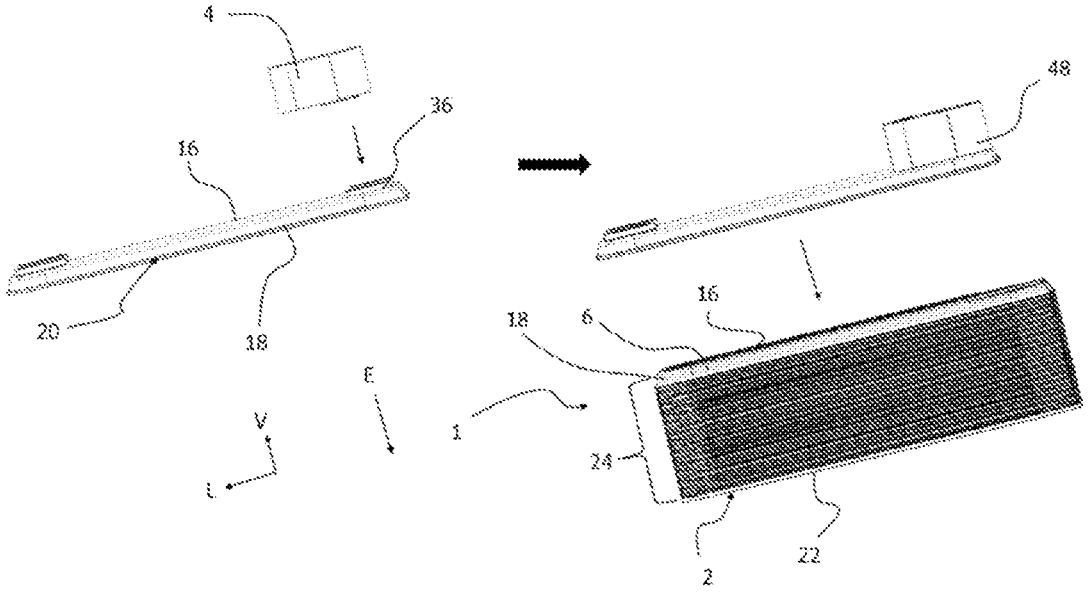
FIG. 6 is an exploded view of the heat exchanger of FIG. 1 showing the fluidic connection block, and the end plate and a plurality of plates forming the body of the heat exchanger.

A method for manufacturing the heat exchanger 1 will now be described with reference to FIG. 6, which schematically shows an exploded view of the main steps in said manufacture. In the remainder of the description, two examples of the manufacturing method will be described, each of the examples differing from the other by virtue of the type of filler material 64 used during said manufacturing.

According to a first example of a manufacturing method, the brazing ring is placed in the groove in the connection block 4 according to the features mentioned above. More specifically, the brazing ring is placed in the groove in the connection block 4 such that it is close at least to the bottom wall and in contact with the inner peripheral wall of said groove.

Following this step, a preliminary step of the manufacturing method is carried out during which the connection block 4, comprising the brazing ring, is fitted on the first end plate 20 of the heat exchange bundle 2, such that said connection block 4 is offset laterally with respect to the circulation wall 16 of the first end plate 20 according to the features described above. In other words, during the preliminary step, the neck 36 associated with the first intake opening 32*a* or with the first outlet opening in the first end plate 20 is inserted into the groove in the connection block 4 in such a way that the latter is offset laterally from the circulation wall 16 of said first end plate 20 and that the neck 36 is at least partially in contact with the brazing ring. In this preliminary step, it is ensured that, in the part 48 of the connection block 4 comprising the first angular part 50 of the groove 40, the neck 36 is at least in contact with the inner peripheral wall 42 in order to generate a lateral offset of this part 48 of the connection block 4 with respect to the circulation wall 16 of the first end plate 20.

It will thus be understood that the preliminary manufacturing step allows the connection block 4 to be positioned covering the first intake opening 32*a* in the first end plate 20, such that the part 48 of the connection block 4 which comprises the second angular portion of the outer peripheral wall of the groove is offset laterally with respect to the circulation wall 16 of said first end plate 20. It will be understood that following this preliminary step, the brazing ring is interposed between the neck 36 of the first intake opening 32*a* or of the first outlet opening and the bottom wall of the groove of the connection block 4.

In order to rigidly secure the connection block 4 to the first end plate 20, and to keep it in position during the rest of the manufacturing method, an operation of crimping said connection block 4 with said first end plate 20 is carried out.

After the preliminary step of assembling and crimping the connection block 4, each of the plates 6 of the bundle body 24 is stacked on top of another in the stacking direction E. Next, the first end plate 20 bearing the connection block 4 is assembled on the bundle body 24 of the heat exchanger 1, at one of its ends, while the second end plate 22 is assembled to the bundle body 24 at an end of said bundle 2 opposite the first end plate 20.

At this stage of the method and advantageously according to the invention, a step is carried out of visual inspection of the presence and/or correct position of the brazing ring within the groove of the connection block 4, using the space in the groove in communication with the external environment of the heat exchanger, formed in the part 48 of the connection block 4 offset laterally with respect to the circulation wall 16 of the first end plate 20, as mentioned above.

Next, a brazing step of the method for manufacturing the heat exchanger 1 is carried out, during which, simultaneously, the plates are brazed together to form the heat exchange bundle 2 and each connection block 4 is brazed to said heat exchange bundle and in particular the first end plate. It will thus be understood that during this brazing step, the brazing ring positioned beforehand in the groove in the connection block 4 fuses with, on the one hand, the connection block and, on the other hand, the neck, so as to ensure the heat exchanger 1 is secured and sealed at the junction between the connection block 4 and the first end plate 20.

Following the brazing step, a subsequent step of inspecting the sealing between the connection block 4 and the first end plate 20 is carried out. To this end, use is made of the first angular part of the groove which is offset laterally from the circulation wall 16 of the first end plate 20 in order to stress the filler material arranged between the neck and the groove. In other words, during the subsequent step of the method, the space formed between the inner peripheral wall and the outer peripheral wall of the groove, which is in communication with the external environment of the heat exchanger 1, is used to verify sealing between the connection block 4 and the first intake opening 32*a* or the first outlet opening.

The subsequent step of inspecting sealing may thus consist of a first sub-step during which a flow of compressed air is injected, via the first angular part of the laterally offset groove and therefore via the space in the groove in communication with the external environment of the heat exchanger 1 as mentioned above. The flow of compressed air thus has the function of ensuring that the filler material is indeed rigidly secured to the inner peripheral wall of the groove of the connection block 4 and to the neck 36 of the first intake opening 32*a* or of the first outlet opening. In other words, during the first sub-step, it is verified that the filler material, in this case the brazing ring, has indeed been fused to the neck 36 and at least the inner peripheral wall of the groove. This ensures that the brazing ring is not simply adhesively bonded to the neck, something which would entail a risk of detachment over time as well as a loss of sealing between the connection block 4 and the first end plate 20.

Following the first sub-step, a second sub-step is carried out during which a fluid is circulated through the fluidic connection block 4 and the heat exchange bundle 2. It is thus understood that this second sub-step of the method aims to test the heat exchanger 1 under normal conditions of use. In particular, it is ensured that fluidic sealing between the connection block 4 and the first intake opening 32*a* or the first outlet opening has been correctly achieved by the fusion of the filler material during the brazing operation. More specifically, it is ensured that fluid does not flow out of the bundle 2 via the groove in the connection block 4, by visually inspecting the first angular part 50 of the groove 40 offset laterally with respect to the circulation wall 16 of the first end plate 20.

A second example of a manufacturing method will now be described. Note that only features that differ from the first example will be described. As regards the features in common, reference should be made to the first example.

According to the second example of the manufacturing method, following the preliminary assembly step, the crimping of the connection block 4 and the assembly of the plates 6 and the end plates 20, 22 according to the features mentioned above, a liquid filler material is injected into the groove in the connection block 4 via the first angular part of the groove which is offset laterally from the circulation wall 16 of the first end plate 20, and which is therefore accessible from outside the heat exchanger 1. The liquid filler material is distributed in the groove such that it fills the groove, so as to ensure that the filler material is at least in contact with the inner peripheral wall and the neck 36 of the first intake opening 32*a* or the first outlet opening. In this manufacturing example, the lateral offset of a part of the groove allows the operator, in addition to being able to visually inspect the presence of the filler material and the quality of sealing after brazing as mentioned above, to inject the liquid filler material after the connection block has been assembled to the first end plate.

The other steps of the second example embodiment are common to the first example embodiment of the manufacturing method.

A second embodiment of the invention will now be described with reference to FIG. 7. Note that in the rest of the description, only features that differ from the first embodiment will be described. As regards the features in common, reference should be made to FIGS. 2 to 5.

Figure 7:
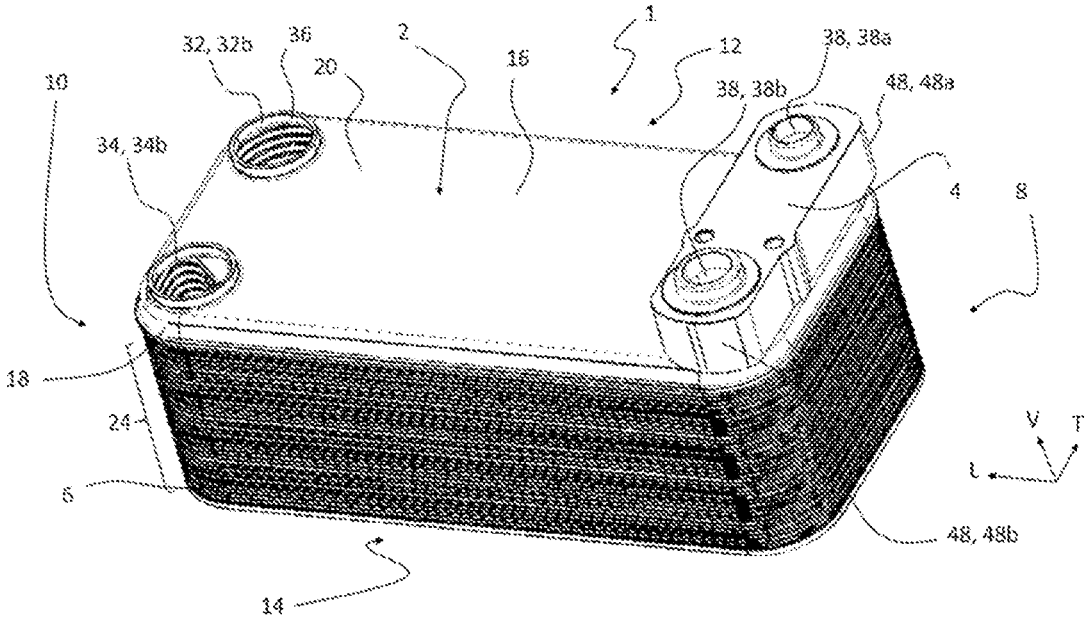
FIG. 7 is a schematic perspective view of the heat exchanger comprising a fluidic connection block according to a second embodiment of the invention.

As can be seen in FIG. 7, the connection block 4 is configured such that it covers the first intake opening and the first outlet opening. It will therefore be understood that the connection block 4 of this second embodiment comprises a first channel 38*a* and a second channel 38*b* respectively in line with the first intake opening and in line with the first outlet opening in the first end plate 20.

Each of the first channel 38*a* and the second channel 38*b* thus comprises respectively a first groove and a second groove, not visible, arranged concentrically around each of said channels 38*a*, 38*b*. The first groove is thus able to interact with the neck, visible in FIG. 2, associated with the first intake opening while the second groove is able to interact with the neck associated with the first outlet opening according to the features mentioned above.

In a manner identical to the first embodiment, the connection block 4 comprises at least one part 48 which is offset laterally with respect to the circulation wall 16 of the first end plate 20. More specifically, the connection block 4 according to the second embodiment comprises a first part 48*a*, which is offset laterally with respect to the circulation wall 16 of the first end plate 20 and which is located at the intersection between the first longitudinal end 8 and the first transverse end 12 of the heat exchanger 1, and a second part 48*b*, which is offset laterally from the circulation wall 16 of the first end plate 20 and which is located at the intersection between the first longitudinal end 8 and the second transverse end 14 of the heat exchanger 1.

The advantage of the particular method for manufacturing the heat exchanger, as well as of the particular structure of said heat exchanger, is that the part of the connection block which is offset laterally from the circulation wall of the first end plate allows double inspection of sealing between the connection block and the intake opening as described above in detail, by virtue of a filler material. The reliability of the heat exchanger and its service life are thus optimized.

Of course, the invention is not limited to the examples that have just been described, and numerous modifications may be made to these examples without departing from the scope of the invention.

The invention claimed is:

1. A heat exchanger for a motor vehicle comprising a heat exchange bundle and at least one fluidic connection block allowing at least one fluid to enter or leave the heat exchange bundle, the heat exchange bundle including a plurality of plates stacked on one another such that they delimit between them a plurality of circulation channels for the at least one fluid, each plate including a circulation wall surrounded by a downward peripheral edge which extends the circulation wall in the direction away from the at least one fluidic connection block, an end plate arranged at the top of the stack being configured to interact with the at least one fluidic connection block, the end plate including at least one opening for fluidic communication between the heat exchange bundle and the at least one fluidic connection block arranged covering the at least one opening, said at least one opening being delimited by a neck which protrudes from the end plate in the direction away from the heat exchange bundle, the at least one fluidic connection block including groove receiving the neck of the end plate, wherein the at least one opening delimited by the neck is formed in a corner of the end plate such that a part of the at least one fluidic connection block, including at least a first angular part of the groove, is offset laterally with respect to the circulation wall of the end plate, wherein the first angular part of the groove is in communication with an external environment of the heat exchanger.

2. The heat exchanger as claimed in claim 1, wherein the end plate includes a downward peripheral edge, wherein at least one part of the at least one fluidic connection block and a portion of the downward peripheral edge of the end plate are arranged relative to one another such that their respective projection on a main plane of extension of the circulation wall of the end plate are substantially coincident.

3. The heat exchanger as claimed in claim 1, wherein the at least one fluidic connection block includes at least one channel which allows the at least one fluid to pass through the at least one fluidic connection block from or toward the heat exchange bundle, the groove in the at least one fluidic connection block being formed concentrically around said at least one channel.

4. The heat exchanger as claimed in claim 1, wherein the groove in the at least one fluidic connection block is delimited laterally by an inner peripheral wall and an outer peripheral wall having a gap therebetween of a value greater than the value of a thickness of the neck of the at least one opening.

5. The heat exchanger as claimed in claim 4, wherein the inner peripheral wall of the groove is at least partially in contact with the neck of the at least one opening and the outer peripheral wall of the groove is at a non-zero radial distance from the neck of the opening.

6. The heat exchanger as claimed in claim 4, wherein an outer diameter of the inner peripheral wall of the groove contacts an inner diameter of the neck of the at least one opening and wherein the outer peripheral wall of the groove includes a first angular portion in contact with the circulation wall of the end plate and a second angular portion forming the part of the at least one fluidic connection block offset laterally with respect to the circulation wall of the end plate, an end face of which facing the heat exchange bundle is free from any contact.

7. The heat exchanger as claimed in claim 4, wherein the inner peripheral wall of the groove and the outer peripheral wall of the groove define between them a space a space in the first angular part of the groove that is in communication with the external environment of the heat exchanger.

8. The heat exchanger as claimed in claim 1, wherein the at least one fluidic connection block is configured to cover two openings formed in the end plate each in a corner of the end plate of the heat exchange bundle, the at least one fluidic connection block including two different channels with a groove formed concentrically around each of the channels and able to interact with a neck arranged around one of the openings.

* * * * *